US005385350A

United States Patent [19]

Norman

[11] Patent Number: 5,385,350

[45] Date of Patent: Jan. 31, 1995

[54] NET ARRANGEMENT FOR A COURT FOR GAMES

[76] Inventor: Neville M. Norman, 90 Sandyhurst Lane, Ashford Kent, United Kingdom

[21] Appl. No.: 817,351

[22] Filed: Jan. 6, 1992

[30] Foreign Application Priority Data

Jan. 4, 1991 [GB] United Kingdom ..... 9100153

[51] Int. Cl.[6] ..... A63B 61/00

[52] U.S. Cl. ..... 273/29B

[58] Field of Search ..... 273/29 B, 30

[56] References Cited

U.S. PATENT DOCUMENTS

| | | | |
|---|---|---|---|
| 3,819,182 | 6/1974 | Lersch | 273/30 |
| 3,980,299 | 9/1976 | Brown | 273/29 B |
| 4,014,251 | 3/1977 | Berman | 273/29 B |
| 4,895,366 | 1/1990 | Bartasius | 273/29 B |

FOREIGN PATENT DOCUMENTS

| | | | |
|---|---|---|---|
| 784191 | 7/1935 | France | 273/30 |

*Primary Examiner*—Theatrice Brown

*Attorney, Agent, or Firm*—Young & Thompson

[57] ABSTRACT

A net arrangement for a court for playing a game resembling tennis or badminton comprising a pair of spaced apart parallel nets which are located transversely across the court thereby constituting two playing areas separated by a no-man's land, to make it more difficult for a strong or tall player to terminate a point prematurely by smashing the ball or shuttle directly downwardly over the net into the opposing playing area. The distance apart of the nets may be varied as well as their location longitudinally of the court, the latter affording handicap possibilities.

3 Claims, 1 Drawing Sheet

NET ARRANGEMENT FOR A COURT FOR GAMES

Figure 1:
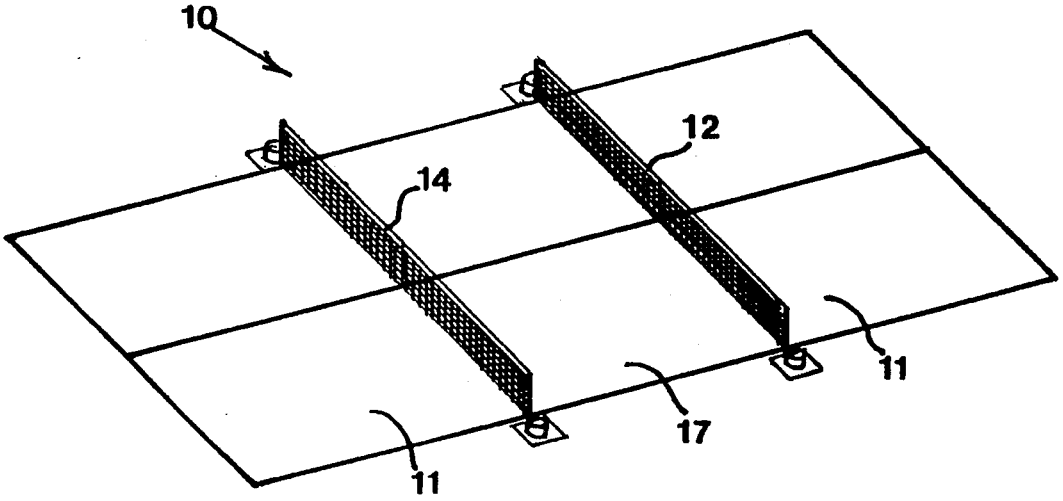

This invention relates to a net arrangement for a court for games and in particular for games such as or resembling, tennis, badminton, quoits and the like.

In particular the invention relates to a game called "Shuttleball" which is played with bats and a giant shuttlecock which has a base made from or resembling a tennis ball.

The game has been played with a high net (approximately 1.5 m) as in badminton but, with a view to providing a game which resembles tennis more closely and in which tennis type strokes may be made, a net of normal tennis height (approximately 1 m) has been proposed. However, this has a disadvantage that due to the slower travel of the shuttlecock, the possibility of smashing the shuttlecock directly downwards over the net increases and the rallies are therefore shortened.

It is an object of the present invention to overcome this disadvantage and at the same time to provide an unexpectedly interesting and challenging game.

The closest prior art known to the Applicant is in UK Patent 599 727 (Hanna) which concerns a court of limited space having a main net which is not across the centre of the court, so that there is a long and a short playing area. A second vertical net is erected across the end of the short area, the net having a height to compensate for the small area. As will be appreciated on a reading of this patent specification the present invention involves a completely different concept, as both nets of the present invention are located between the two playing areas.

As the present invention includes a zone between playing areas, mention is made of U.K. Patent 1 327 163 (Huntington Hartford) in which a ball and racket game is described including two spaced apart playing areas which are raised above ground level and separated by a gap in which a ball deflector or net is located below the level of the playing areas. The game is designed to simulate the playing of lawn tennis.

This is not the principle of the present invention in which the playing areas are at ground level and are separated by two vertical nets. The above U.K. Patent 1 327 163 has no vertical nets between the playing areas.

In view of the provision of a double net in the present invention, regard must be directed to U.S. Pat. No. 4,886,268 (Langslet) in which two lower nets are provided adjacent each side of the main net of a tennis court to catch balls which might otherwise drift onto the playing surface after striking the main net and dropping down. These two extra nets do not affect the play of a point and only function to capture and restrain balls after the completion of a point. This patent therefore has a different object and principle from the proposed patent in which the double nets are spaced apart to affect the playing of points.

Another reference cited in the search report for U.K. Patent Application 9100153.7 was U.S. Pat. No. 3,544,109 (Woods). In this patent, a playing area for a ball game is centrally divided longitudinally by a net or barrier to constitute two playing surfaces for half of each of the opposing teams, for the purpose of permitting cross passing across the net. Transverse nets are also located at either end of the court to physically confine the players to the playing surface away from the scoring baskets which are located outside the playing area. This is a different concept from the present invention which has no central longitudinal barrier, no nets or barriers at the ends of the court or playing areas and no scoring baskets located outside the playing areas.

According to the invention a net arrangement for a court for a game resembling tennis or badminton is characterised by a pair of spaced apart transverse parallel nets or other suitable barriers adapted to be located on the court to separate two playing areas by a zone between the nets.

The nets may be made from conventional mesh but it will be appreciated that sheets of other material, for example plastic sheets may also be used.

The distance apart of the nets is chosen having regard to many parameters, including the age group and playing ability of the players but it has been found that a distance of from about two to about five meters (or yards) is preferred.

In a refinement of the invention the pair of nets is movable along the length of the court so that one player may be given a relatively smaller area to play on. Means for the easy movement of the nets may be provided and this also permits easy adjustment of the zone between the nets. It has been found that the nets should be closer together for weak players.

EMBODIMENT OF THE INVENTION

Figure 2:
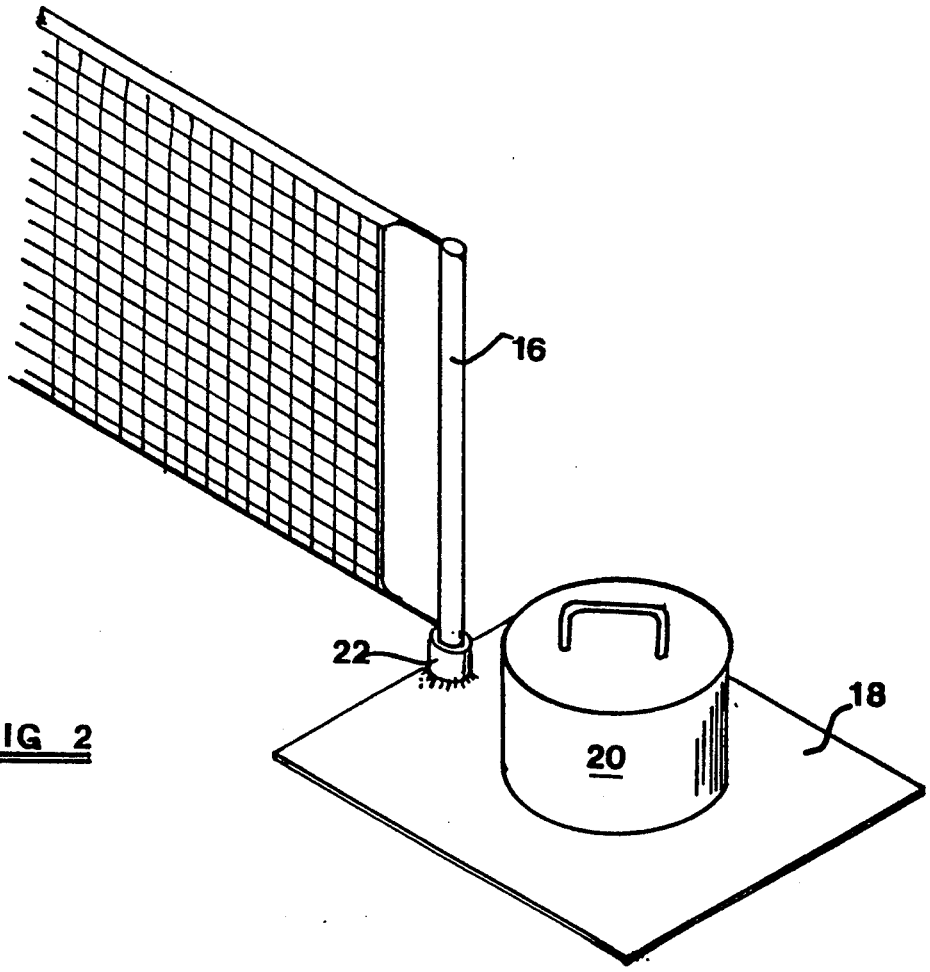

An embodiment of the invention is described below with reference to the accompanying drawings in which:

FIG. 1 is an isometric view of a court with a net arrangement according to the invention; and FIG. 2 is a detail of an anchorage for the nets.

The court 10 is marked off as shown into two playing areas 11 but it will be appreciated that the dimensions will vary according to the space available, and the markings may be adapted as required. For the game of SHUTTLEBALL a total length of court of 12 m–15 m and a width of 6 m–9 m has proved ideal.

A pair of nets 12, 14 of about hip height is provided and these are spaced apart a distance of the order of between 2 and 5 meters, a distance which has been found adequate to prevent rally-stopping smashes because the players have to volley at an angle to the horizontal instead of being able to smash directly downwardly. Thus, a zone, or a "no-man's land" 17 is established over which the ball or shuttle has to travel before landing on the opposing court.

As mentioned above, the nets may be movable up and down the court to provide a handicap aspect.

This may be achieved by providing the posts 16 of the nets designed to fit snugly into sockets 22 which are attached to a plate 18 for receiving a mass 20 which is sufficient to anchor the post during play but which is easily moved for the posts to be moved to another location.

The court may be provided with a series of orifices (not shown) along the length of the court so that the poles, without plates, can be located in any of several positions so that their longitudinal location and their distance apart can be varied according to requirements.

I claim:

1. A shuttlecock court for playing a shuttlecock game with a shuttlecock, the court having a length of 12 m–15 m and a width of 6 m–9 m on which players move around and wherein the shuttlecock does not touch the court during the playing of a point, and a pair of spaced apart transverse nets having a height about 0.75 m to about 1.2 m extending across the court and separating two playing areas by a penalty zone between the nets.

2. A shuttlecock court as claimed in claim 1, and means mounting the pair of nets for movement along the length of the court.

3. A shuttlecock court according to claim 1, the distance between the nets being about 2 m–5 m.

* * * * *